United States Patent [19]

Stock

[11] 4,413,753

[45] * Nov. 8, 1983

[54] DISPENSER FOR CYANOACRYLATE ADHESIVES

[75] Inventor: Hugh J. Stock, Saratoga, Calif.

[73] Assignee: Pacer Technology and Resources, Inc., Campbell, Calif.

[ * ] Notice: The portion of the term of this patent subsequent to Oct. 11, 2000 has been disclaimed.

[21] Appl. No.: 346,117

[22] Filed: Feb. 5, 1982

Related U.S. Application Data

[63] Continuation of Ser. No. 150,151, May 15, 1980, abandoned.

[51] Int. Cl.[3] ..... B01L 3/00; B65D 1/08; B65D 17/24

[52] U.S. Cl. ..... 222/149; 222/420; 222/541; 222/546

[58] Field of Search ..... 222/149, 153, 206, 215, 222/420, 545, 546, 562, 563, 541

[56] References Cited

U.S. PATENT DOCUMENTS

| | | | |
|---|---|---|---|
| 2,742,202 | 4/1956 | Dresden et al. | 222/541 |
| 2,761,598 | 9/1956 | Darlington, Jr. | 222/541 |
| 3,204,835 | 9/1965 | Michel | 222/541 |
| 3,227,332 | 1/1966 | Gowdy et al. | 222/546 X |
| 3,303,847 | 2/1967 | Eaton | 222/215 X |
| 3,858,739 | 1/1975 | Turner et al. | 222/541 X |
| 3,908,654 | 9/1975 | Choest et al. | 222/541 X |

*Primary Examiner*—David A. Scherbel

*Attorney, Agent, or Firm*—Cahill, Sutton & Thomas

[57] ABSTRACT

A constant diameter or segmented constant diameter passageway within a dispensing tip channels and dispenses a cyanoacrylate adhesive from a container through a discharge outlet at the extremity of the tip. A stopper for the tip includes a plunger for matingly and penetrably engaging the passageway to force reverse flow of the cyanoacrylate adhesive back into the container. The forced flow, due to the viscosity and surface tension characteristics of the cyanoacrylate adhesive, initiates complete drainage of the passageway and prevents any crusting and clogging of the cyanoacrylate within the passageway. The stopper is manufactured attached to the end of the tip at a weakened junction for breakaway separation by the ultimate user, which junction insures the establishment of a sharp edged discharge orifice at the tip to promote accurate dispensation of cyanoacrylate adhesive and to prevent clogging of the orifice. A two phase interlock secures a cap to the container and includes flanges extending from the cap for engaging lugs located about the mouth of the container which flanges are disengageably engageable with the lugs by rotating the cap relative to the container. A key extends from the cap into a key way in the container to prevent rotation of the cap relative to the container absent withdrawal of the key from the key way by deliberate precise flexing of the cap. The mating configuration of the tip and container promotes welding of these components to one another and effect a seal therebetween.

4 Claims, 14 Drawing Figures

DISPENSER FOR CYANOACRYLATE ADHESIVES

This is a continuation of application Ser. No. 150,151 filed May 15, 1980, now abandoned.

The present invention relates to inventions described in copending U.S. patent applications entitled "Child Proof Dispenser", Ser. No. 119,635 filed Feb. 7, 1980 now U.S. Pat. 4,334,638, and "Dispensing Tip For Cyanoacrylate Adhesives", Ser. No. 119,452, filed Feb. 7, 1980, now abandoned which describe inventions conceived and reduced to practice by the present inventor and which applications are assigned to the present assignee.

The present invention relates to dispensers and, more particularly, to dispensers for fluids.

As a result of safety regulations, variously locked caps for containers have been developed to prevent inadvertent ingestion by a child of the container contents. Wide mouthed pill containers often incorporate a cap which is rotatably mounted and removable only upon alignment of an index on the cap with a corresponding index on the container. Upon such alignment, the cap may be pried off with relative ease. With screw on caps, a locking detented mechanism is often used which requires simultaneous depression and rotation of the cap for the cap to come into threaded engagement with the container and to be removable therefrom. Various adaptations of mechanisms which require the above described simultaneous dual repositioning of the cap relative to the container have been developed. All of them however, require a certain degree of looseness in fit of the cap when the cap is lockingly in place. Moreover, the above described caps are primarily used with wide mouth containers for pills and like medications.

Cyanoacrylate adhesives have been used for a number of years for adhesively mating closely fitted components. A basis for selecting a cyanoacrylate adhesive in such applications in preference to some other adhesive is that the cyanoacrylate adhesive will wick or creep through tightly fitted joints before polymerizing and effecting a bond therebetween. Moreover, the volume of the resulting cured adhesive is essentially commensurate with the space between tightly fitting components and will not impede, dislodge or otherwise reposition or reorient the mated components.

One of the problems attendant any dispenser for cyanoacrylate adhesives is that of polymerization or crusting of the adhesive in proximity to the dispensing tip and discharge outlet. This problem is well recognized in U.S. Pat. No. 3,523,628; therein a spring loaded ball sealingly bears against the discharge outlet to evacuate the cyanoacrylate adhesive from within the outlet after dispensation of a quantity of cyanoacrylate adhesive.

In some dispensers for cyanoacrylate adhesives, the passageway has been flared from the discharge outlet toward the container itself in the belief that by having a large passageway diameter, bridging of the cyanoacrylate adhesive across the passageway would be avoided and polymerization or crusting would be precluded. By experiments, it has become evident that crusting will still occur.

It is therefore a primary object of the present invention to provide a non-clogging dispensing tip for cyanoacrylate adhesives.

Another object of the present invention is to provide a self-draining tip for dispensing cyanoacrylate adhesives.

Yet another object of the present invention is to provide dispensing tip for a container, which dispensing tip includes a single or segmented constant diameter passageway having sharp edged annular terminations for dispensing cyanoacrylate adhesives.

Still another object of the present invention is to provide a plunger for initiating evacuation of any cyanoacrylate adhesive from within the passageway and outlet of a dispensing tip.

A further object of the present invention is to provide a detachably attachable stopper for evacuating the passageway of a cyanoacrylate adhesive dispensing tip.

A yet further object of the present invention is to provide a stopper and dispensing tip configuration which is fabricatable by molding processes as a single unit with a breakaway junction which junction creates a sharp edged discharge orifice at the dispensing tip.

A still further object of the present invention is to provide a dispenser having a container and a container cap secured by a sequentially operated dual lock mechanism.

These and other objects of the present invention will become apparent to those skilled in the art as the description thereof proceeds.

The present invention will be described with greater specificity and clarity with reference to the following drawings, in which.

Figure 1:
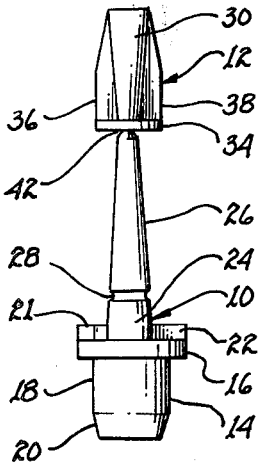
FIG. 1 is a side view of a dispensing tip and stopper prior to separation therebetween.

FIG. 1 illustrates a dispenser tip 10 and a stopper 12 molded as a single unit and severable from one another either before or after prior attachment of the base of the tip to a container. In the preferred embodiment described herein, the unit is attached to the container and severance is made by the ultimate user of the product, which delay maintains the container hermetically sealed until first use of the fluid. By molding the dispenser tip and stopper as a unit, the number of units that must be handled in fabrication and assembly is reduced by one half, which brings about handling, storage and assembly economies. The dispenser tip includes a hollow boss 14 extending downwardly from a disc section 16, which boss includes a constant diameter cylindrical section 18 and a radially inwardly tappered section 20. Diametrically oriented lugs 21, 22 extend upwardly and provide structural support intermediate base 24 of tip 26 and disc section 16; they are also employed as means cooperating with apparatus for welding the dispensing tip to the container. Tip 26 is tapered and it includes an annular groove 28 disposed in proximity to base 24 and a passageway extending through the tip.

Stopper 12 is formed by a hollow cone shaped section 30 for mating with tip 26. A plug 32 (see FIG. 4) extends from the apex interior of the cone shaped section. A disc 34 is disposed in proximity to the apex of cone shaped section 30. Flanges 36 and 38 extend from the disc to the exterior surface of the cone shaped section to provide structural rigidity to stopper 12; additionally, these flanges tend to restrain diametric expansion of the lower end of the cone shaped section and aid in handling the stopper. In proximity to the interior and base of cone shaped section 30, there is disposed an inwardly oriented annular ridge 40 (see FIG. 3) dimensioned to grippingly mate with groove 28 of tip 26. The ridge and groove serve in the nature of detent means to maintain the stopper upon the tip.

The junction between the end of tip 26 and disc 34 is defined by an annular indentation 42 which, in cross-section, is V-shaped and defines a small angle at the apex. One leg of the "V" may be the planar surface of the disc. Nominally, the wall thickness between the interior dimension of the indentation and the circumscribed passageway is 0.020 inches.

Figure 2:
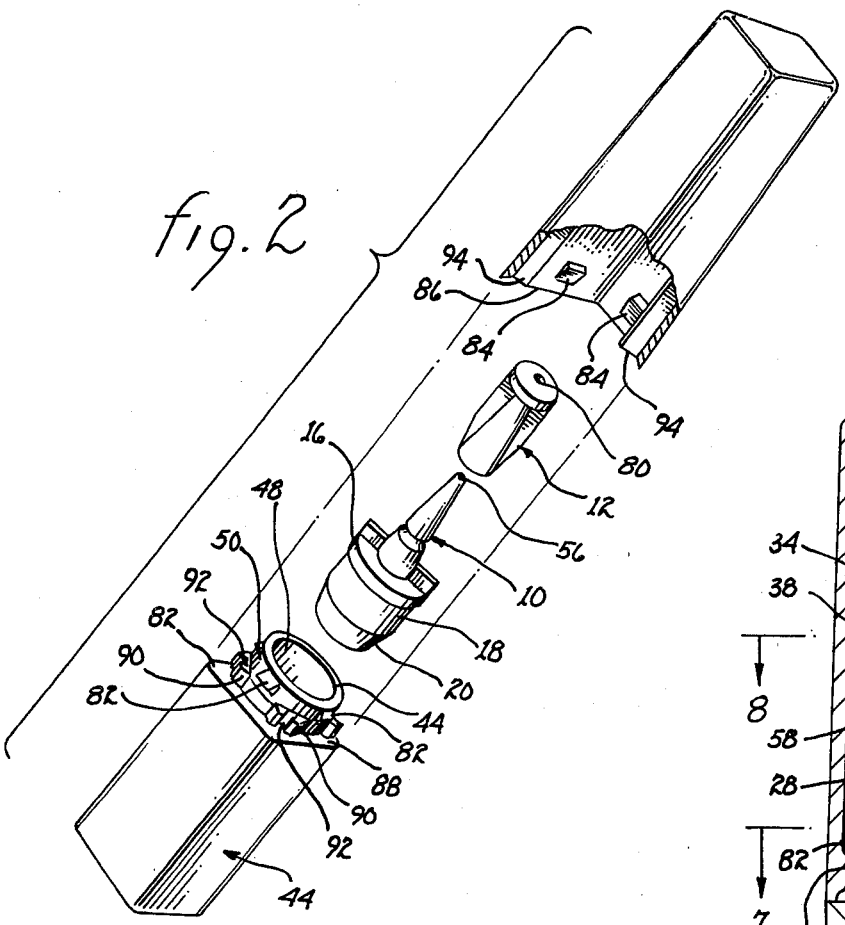
FIG. 2 is an isometric view of the components of a dispenser for cyanoacrylate adhesives.
Figure 4:
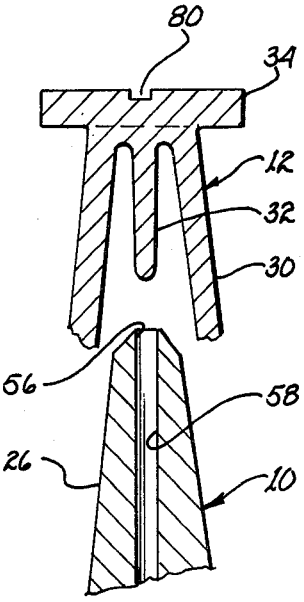
FIG. 4 is a partial cross-sectional view illustrating the mating of the stopper with the dispensing tip.

After attachment of the dispenser tip within the neck of a container, the dispenser tip and the stopper are readily manually or otherwise severed from one another, as shown in FIG. 4. Upon severance, exposed orifice 56 (see FIG. 2) at tip 26 is left smooth and neither ragged nor torn because of the thin wall defined by the indentation. For reasons which will be described in further detail below, plug 32 of stopper 20 extends into the orifice of passageway 58 and mates with the passageway on attachment of the stopper to the tip.

The major component parts of a dispenser constructed in accordance with teachings of the present invention are shown in FIGS. 2, 3, 4, and 5. A container 44 for the fluid 45 to be dispensed, such as one of the family of cyanoacrylate adhesives, includes a mouth 46 defined by an internal cylindrical surface 48 of container neck 50 extending from shoulder 52. The diameter of the cylindrical surface 46 is the same as or somewhat less than the diameter of cylindrical section 18 of dispenser tip 10 to insure a frictional or force fit therebetween; tapered section 20 aids in insertion of the cylindrical section within the cylindrical surface and mates with a correspondingly tapered shoulder 54 (see FIG. 3).

Stopper 12 engages tip 26 which engagement brings about insertion of plug 32 through orifice 56 into passageway 58 (see FIG. 3) in the tip and mating of the ridge 40 in the stopper with groove 28 of the tip.

A cap 60 encloses dispenser tip 10 and its attached stopper 12 upon engagement of the locking mechanisms disposed in the cap with the locking mechanisms disposed about cylindrical neck 50.

Figure 6:
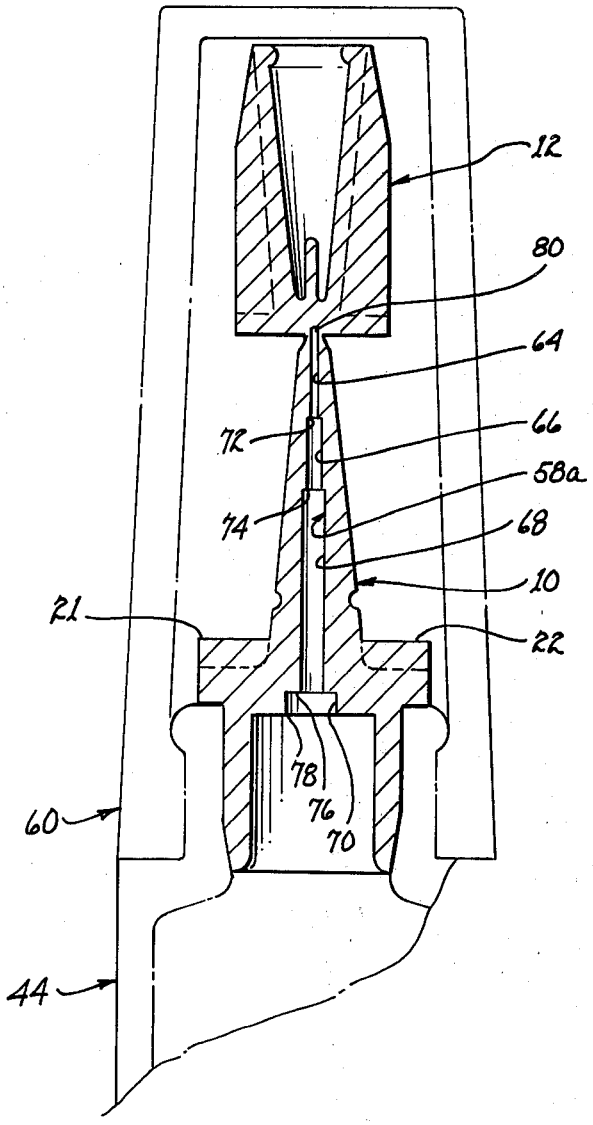
FIG. 6 is a partial cross-sectional view of the dispensing tip inserted within a container prior to detachment of the stopper and enclosed within a cap for the container.
Figure 7:
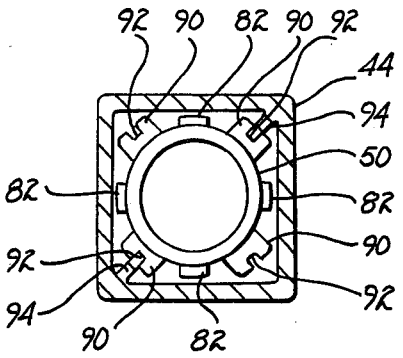
FIG. 7 is a cross-sectional view taken along lines 7—7, as shown in FIG. 3.
Figure 8:
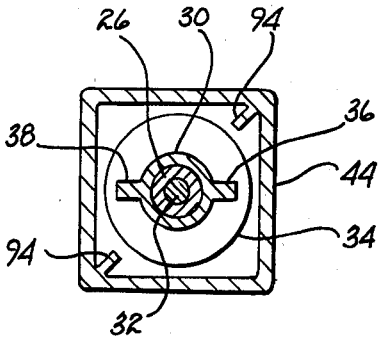
FIG. 8 is a cross-sectional view taken along lines 8—8, as shown in FIG. 3.
Figure 9:
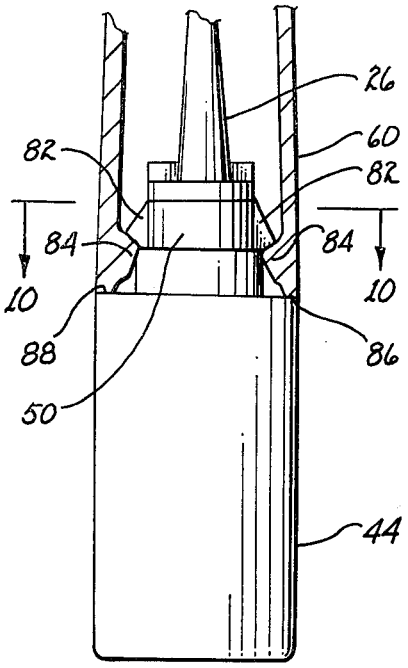
FIG. 9 is a partial cross-sectional view illustrating one part of the two part lock securing the cap to the container.
Figure 10:
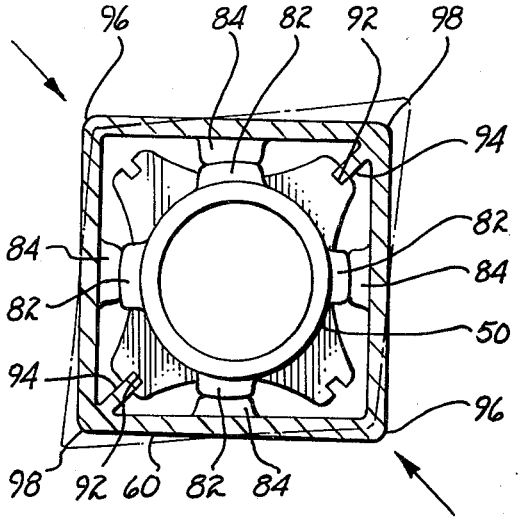
FIG. 10 is a cross-sectional view taken along lines 10—10, as shown in FIG. 9.
Figure 11:
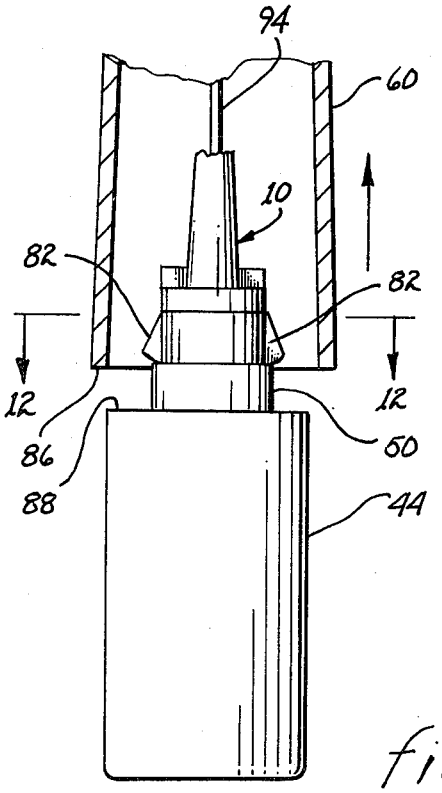
FIG. 11 is a partial cross-sectional view illustrating the unlocked disengagement upon relative rotation between the cap and the container.

FIG. 6 illustrates tip 10 attached to container 44 and enclosed within cap 60. It may be noted that stopper 12 has not been detached from the tip. That is, the cap is specifically dimensioned so as to permit shipment of the dispenser from the manufacturer through various distribution channels to the ultimate user while maintaining the dispenser hermetically sealed.

By experimentation, it has been learned that evacuation of the cyanoacrylate adhesive within the passageway in a dispensing tip leading to the discharge outlet is a complex function of several variables, including propensity for rapid polymerization, surface tension, configuration of the passageway and the degree of surface energy of the material defining the passageway and discharge outlet. Initially, it was believed that by having the passageway flare toward the container, bridging thereacross of the cyanoacrylate adhesive would be avoided and polymerization or crusting sufficient to clog the passageway would be constrained. Such is not the case.

Contrary to expectations of those skilled in the art, essentially total drainage of a cyanoacrylate adhesive will occur in a constant or segmented constant diameter passageway provided each downstream passageway termination is sharp edged. Moreover, evacuation appears to be aided if forced gravity flow is initiated. To the extent presently understood, it is believed that this phenomenon is primarily a function of surface tension of the cyanoacrylate adhesive and that the surface tension, in combination with the other parameters discussed above, will support continuing drainage after an initial flow is provided by means of a plunger or the like.

Accordingly, as noted in various of FIGS. 1–6, plug 32 is formed within stopper 12 to penetrably engage an upper part of passageway 58 on mating of the stopper with the dispensing tip. The initial insertion of the plug within the passageway will initiate forced downward flow of any cyanoacrylate adhesive coming in contact therewith or by a pressure rise of the air within the passageway between the penetrating end of the plunger and any cyanoacrylate adhesive within the passageway. The initial downward flow, on comingling with any further cyanoacrylate adhesive in the remainder of the passageway will, by means of what is believed to be on "avalanche" effect, initiate and maintain essentially complete drainage of the cyanoacrylate adhesive from the passageway back into the container.

As may be deduced from the above description of the structure of stopper 12 and dispenser tip 10, engagement of ridge 40 with groove 28 will maintain the stopper attached to the dispensing tip to prevent inadvertent opening of passageway 58 by withdrawal plug 32. Additionally, the combined effect of plug 32 mating with passageway 58, tapered tip 26 mating with the interior cone-shaped surface of cone-shaped section 30 and ridge 40 mating with groove 28 will provide an air tight or near air tight seal to prevent flow of fluid, whether cyanoacrylate adhesive or air, into and out of container 44.

Figure 3:
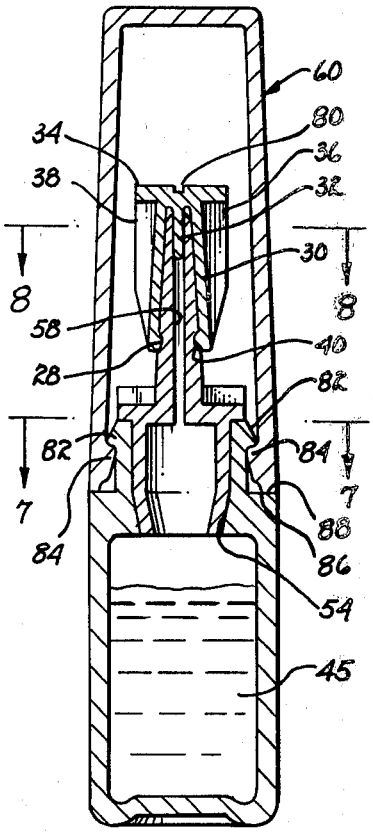
FIG. 3 is a cross-sectional view of the dispenser.
Figure 5:
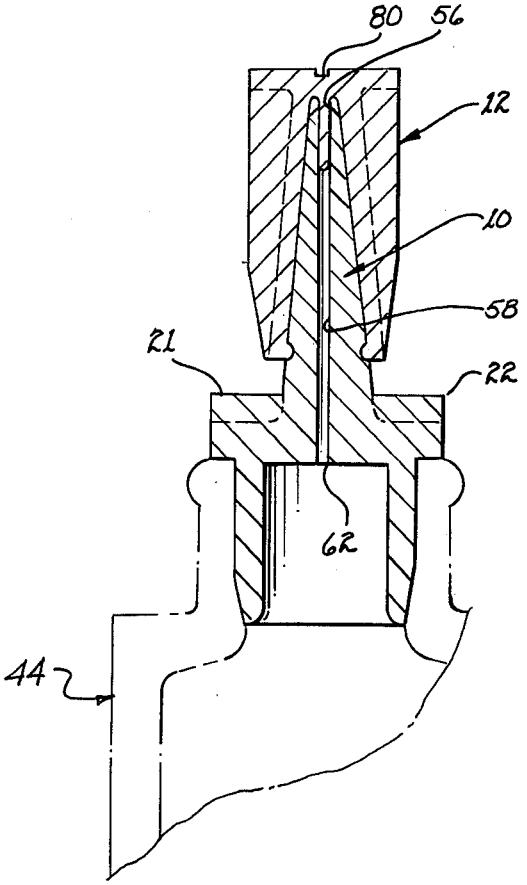
FIG. 5 is a partial cross-sectional view illustrating the stoppered dispensing tip mounted in a container.

The various parameters attendant the configuration of passageway 58 will be reviewed with joint reference to FIGS. 3, 5 and 6. For reasons stated above, the wall defining the passageway should not be tapered or else clogging and crusting will often occur due to poor drainage and subsequent "bridging" of the cyanoacrylate adhesive.

Because of the tolerances necessary, injection molding is employed to fabricate the tip and stopper as a single unit. The tolerance obtainable thereby permits the formation of a very smooth wall for passageway 58 and allows maintenance of a constant diameter in the range of 0.016-0.053 inches throughout. To aid and encourage separation of any drained cyanoacrylate adhesive from passageway 58 back into container 44, inlet orifice 62 is deliberately sharp edged. Such a sharp edge essentially eliminates dependency therefrom of any residual drops or droplets.

The limitations extant and attendant injection molding place a constraint upon the maximum length of passageway 58 which can be formed to the tolerance required in conjunction with the diameter of the passageway and the decreasing wall thickness and diameter of tip 26. To solve this problem for extended length tips extensive experimentation led to the configuration of passageway 58*a* illustrated in FIG. 6. This passageway avoids the constraints imposed by injection molding limitations and provides a passageway which will drain and not become clogged. Passageway 58*a* includes a plurality of ascending diameter constant diameter sections 64, 66, 68 and 70. At the junction of adjoining sections sharp edged annular shoulders 72, 74, 76 and 78, respectively, are formed. Drainage of any residual cyanoacrylate adhesive through each of sections 64, 66, 68 and 70 will occur for reasons stated above. At each shoulder, the sharp edge provides insufficient purchase for the surface tension attendant any drop or droplet to support in depending relationship the drop or droplet. Thus, drainage is assured. In one embodiment of passageway 58*a* the dimensions of the sections are:

| | diameter | length |
|---|---|---|
| Section 64 | 0.040" | 0.295" |
| Section 66 | 0.084" | 0.305" |
| Section 68 | 0.09375" | 1.267" |
| Section 70 | 0.250" | 0.123". |

As briefly discussed above, the termination of tip 26 defining orifice 56 should be smooth and sharp edged to prevent retention thereat of a cyanoacrylate adhesive droplet which might crust or clog the orifice. With break away junctions formation of such an edge is usually a problem. The solution to this problem embodied in the present invention is two fold. First, passageway 58 or 58*a* is formed to extend completely through tip 26 and partially into disc section 34 of stopper 12, as particularly illustrated in FIGS. 5 and 6. Annular indentation 42 has a V-shaped cross-section of a small apex angle and circumscribes tip 26 adjacent the planar surface of disc section 16. Such an indentation, when stopper 12 is manually or non-manually broken away from tip 10, will result in a sharp edged termination of tip 26 having a cone shaped configuration and essentially smooth surface that is not jagged or torn and which defines orifice 56, as particularly illustrated in FIG. 4. A small recess 80, formerly an extension of the passageway formed in the dispenser/stopper unit when manufactured, exists within the surface of disc 34, which recess is of no impact to the operation of the stopper. However, the extension of the passageway past indentation 42 into the disc insures that the orifice resulting after breakaway of the tip is well defined and smoothly circumscribed.

The elements of the locking mechanisms intermediate cap 60 and container 44 will be described with joint reference to FIGS. 2, 3, 7, 8, 9, 10, 11 and 12. Four lugs 82 are equiangularly disposed about the surface of cylindrical neck 50. These lugs are shaped in the nature of downwardly oriented louvers, as illustrated. Cap 60 includes four flanges 84 extending inwardly from the inner walls of the cap and positionally correspond with lugs 82 to obtain a mating interlock therebetween on positioning of bottom edge 86 of the cap with shoulder 88 of the container. These flanges are upwardly oriented louver-lik elements, as illustrated.

In cross-section, ap 60 is square and lower edge 88 is dimensioned generall commensurate with the square cross-sectional configuratin of container 44. Abuttments 90 are disposed proximate ach corner edge of container 44 and extend upwardly from houlder 88. Each of these abuttments define a channel 92 extending upwardly from shoulder 88 and in radial alignment with cylindrical neck 50. Cap 60 includes, in two opposed corners, inwardly extending ribs 94. These ribs are dimensioned in width and breadth to engage diametrically opposed ones of channels 92 on positioning of cap 60 upon container 44 when bottom edge 86 is adjacent shoulder 88. As noted in FIG. 10, the ribs are configured not to interfere with disc 34 of stopper 12.

Figure 12:
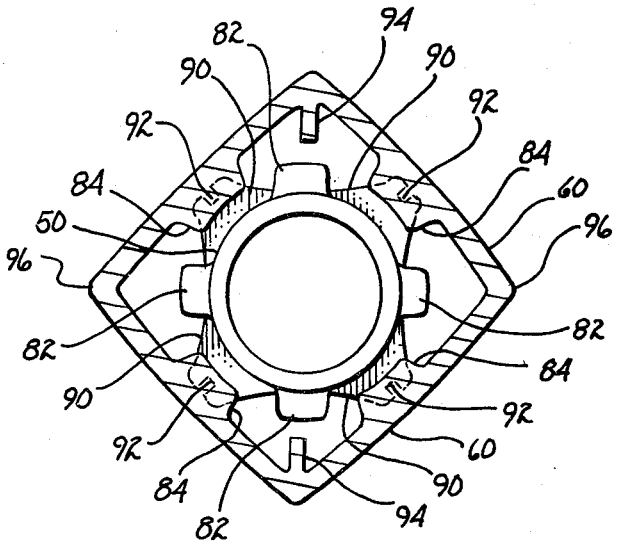
FIG. 12 is a cross-sectional view taken along lines 12—12, as shown in FIG. 11.

Attachment and detachment of cap 60 with container 44 will be described in reference to FIGS. 9, 10, 11 and 12. To detach the cap from the container, diametrically opposed corners 96 of the cap, which corners do not include ribs 94, are squeezed together. The resulting flexing of cap 60 causes diametrically opposed corners 98 to be laterally displaced from one another. The resulting displacement withdraws ribs 94 from their mating channels 92. On disengagement, the constraints intermediate the cap and container relative to rotation therebetween are removed. Simultaneous with the squeezing of corners 96 and after disengagement of the ribs, cap 60 is rotated relative to container 44 about the longitudinal axis of the cap and container. Such rotation will result in angular displacement of flanges 84 relative to lugs 82 and is continued until the flanges are no longer in contacting relationship with the respective lugs. This position is illustrated in FIG. 12. The cap may now be removed from container 44.

Assembly of cap 60 with container 44 is a reverse implementation of the above described operation. That is, cap 60 is placed upon container 44 such that flanges 84 are in general alignment with abuttments 90; thereafter, the cap is rotated about its longitudinal axis relative to the container until the flanges slidably engage and interlock with lugs 82. Simultaneously, corners 96 of the cap are squeezed toward one another to allow clearance between ribs 94 and the pertaining ones of abuttments 90. Upon sufficient rotation of the cap with respect to the body to align the corner edges of the cap with the corner edges of the container, ribs 94 will become aligned with channels 92 and the cap may be released. At this point, rotation of the cap with respect to the container is constrained by the mating of ribs 94 with channels 92 in the abuttments; vertical displacement of the cap with respect to the container is prevented by the interlocking relationship between lugs 82 and flanges 84.

From the above description it will become apparent that edge 86 of the cap may be force fit against shoulder 88 by appropriate location of lugs 82 and/or flanges 84 to rigidly retain the cap. Moreover, the tightness of fit between the cap and the container has no effect upon leakage as stopper 10 is employed to seal the dispensing tip passageway.

The extensive contact area between cylindrical section 18, tapered section 20 and the underside radial surface of disc section 16 with corresponding surfaces of cylindrical neck 50 of container 44 permits a weld therebetween to be formed to ensure a total seal between the dispenser tip and the container, despite variations in manufacturing tolerances and possible deformation of the mating surfaces due to scratches, etc.

Figure 13:
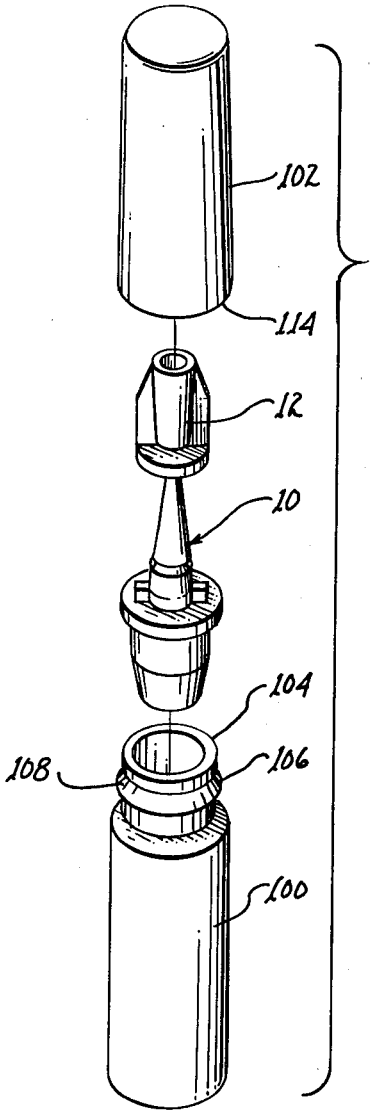
FIG. 13 is an isometric view of a variant of the dispenser.
Figure 14:
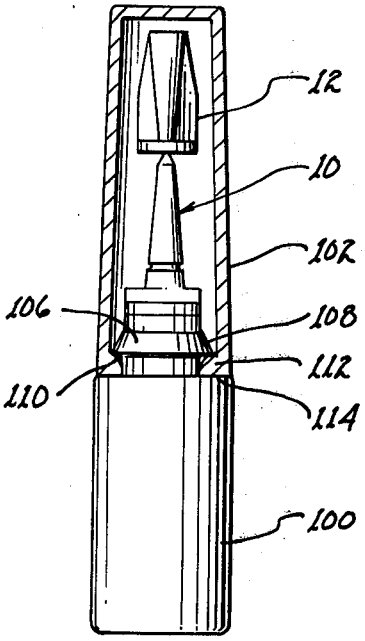
FIG. 14 is a partial cross-sectional view of the variant.

FIGS. 13 and 14 illustrate a variant of the dispenser. In the variant, both container 100 and cap 102 are circular rather than square in cross-section. The container supports a cylindrical neck 104 for receiving tip 10 and attached stopper 12, as above described. The mechanism for detachably attaching cap 102 to the container includes an annular ridge 106 disposed about the cylindrical neck and having a sloping surface 108 and a surface 110 normal to the longitudinal axis of the neck. A radially inwardly oriented protrusion 112 is formed proximate edge 112 of the cap for detachable snap fit engagement with ridge 106. Thereby, the cap can be readily removed and reattached to the container.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. A dispensing tip internally attachable to the mouth of a necked container of liquid adhesive for dispensing the adhesive, said dispensing tip comprising in combination:

(a) an hollow boss for sealingly engaging the interior cylindrical surface of the neck of the container, said boss including a disc section extending across the mouth of the container for supportingly contacting the extremity of the neck;

(b) a conical tip extending from said boss for dispensing the adhesive;

(c) a diametrically oriented ridge extending from said disc section on opposed sides of said conical tip for providing an engageable element by apparatus used to install and hermetically seal said dispensing tip with the container;

(d) a passageway extending from said hollow boss through said conical tip for discharging the adhesive to be dispensed;

(e) a stopper detachably attached to the end of said conical tip for hermetically sealing said passageway prior to detachment of said stopper from said tip, said stopper including a disc extending radially at the extremity of said conical tip, an inverted conical shroud extending from the axial center of said disc, said conical shroud including a cavity having an interior conical surface for receiving said conical tip and a plug enclosed within said cavity for engaging said passageway on mounting of said stopper upon said conical tip to force flow of any residual adhesive within said passageway into the container, and a pair of flanges disposed upon opposed sides of said shroud and joined with said disc for providing an enlarged surface area to grip said stopper and which grip in constrained against sliding by said disc;

(f) a break away junction between said tip and said stopper for detaching said stopper from said tip, said junction including an annular indentation about said tip and circumscribing said passageway; and (g) a length of said passageway extending beyond said junction and into said disc for assuring formation of a discharge outlet on detachment of said stopper from said tip.

2. The dispensing tip as set forth in claim 1 wherein said indentation is V-shaped in cross-section and the apex of said V-shaped indentation is an acute angle and wherein the apex has a radius 0.0020 inches greater than the radius of said passageway to define a sharp edged discharge outlet on detachment of said stopper.

3. The dispensing tip as set forth in claim 2 wherein one side of said indentation is coincident with a surface of said disc section.

4. The dispensing tip as set forth in claim 1 wherein said passageway includes a plurality of constant diameter sections arranged in ascending diameter from said tip end to said hollow boss, each junction between said constant diameter sections includes a sharp edged shoulder disposed in a plane normal to the longitudinal axis of said passageway.

* * * * *